United States Patent [19]

Stumpp

[11] 4,284,047

[45] Aug. 18, 1981

[54] APPARATUS FOR CONTROLLING THE AIR-FUEL QUANTITY RATIO IN INTERNAL COMBUSTION ENGINES

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 65,237

[22] Filed: Aug. 9, 1979

[30] Foreign Application Priority Data

Sep. 26, 1978 [DE] Fed. Rep. of Germany ..... 2841807

[51] Int. Cl.[3] ..... F02M 41/00

[52] U.S. Cl. ..... 123/449; 123/457; 123/459; 123/505; 417/289

[58] Field of Search ..... 123/139 AW, 139 BD, 123/139 BG, 449, 459, 457, 505, 506; 417/289, 294, 480, 900

[56] References Cited

U.S. PATENT DOCUMENTS

| | | | |
|---|---|---|---|
| 3,058,455 | 10/1962 | Hofer et al. | 123/139 BD |
| 3,942,914 | 3/1976 | Hofer et al. | 123/139 BD |
| 4,031,873 | 6/1977 | Banzhaf et al. | 123/139 AW |
| 4,143,631 | 3/1979 | Stumpp | 123/139 AW |
| 4,161,934 | 7/1979 | Stumpp | 123/139 AW |
| 4,205,645 | 6/1980 | Eheim | 123/139 BG |

FOREIGN PATENT DOCUMENTS

| | | | |
|---|---|---|---|
| 197807 | 7/1978 | Fed. Rep. of Germany | 123/139 BG |
| 2008675 | 6/1979 | United Kingdom | 123/139 AW |

*Primary Examiner*—Ira S. Lazarus
*Assistant Examiner*—Magdalen Moy
*Attorney, Agent, or Firm*—Edwin E. Greigg

[57] ABSTRACT

An apparatus for controlling the ratio of air to fuel quantity of the operational mixture to be introduced into the combustion chambers of an internal combustion engine which includes an air flow rate meter moving under differential pressure against a constant hydraulic restoring force, which air flow rate meter adjusts a metering cross section in a supply line leading to a fuel injection pump, with the pressure drop at the metering cross section being maintained constant with the aid of a differential pressure valve. The air flow rate meter is part of a known apparatus which controls the fuel component in accordance with the quantity of aspirated air and also controls the component of exhaust gas to be fed back. The hydraulic restoring pressure for the air flow rate meter is drawn via a throttle from the supply side of a supply pump which supplies the injection pump with fuel under an rpm-dependent pressure and with a quantity of fuel intended for flushing and the pressure downstream of the throttle is maintained at a constant value by means of a pressure maintenance valve. The working chambers of the injection pump communicate only with either the injection lines or the fuel supply line controlled by the air flow rate meter, so that the control result is not adulterated by the flushing quantity or by a shutoff quantity. In this manner, the injection pump and the control device can be supplied with fuel and with pressure fluid by means of a single supply pump.

10 Claims, 2 Drawing Figures

APPARATUS FOR CONTROLLING THE AIR-FUEL QUANTITY RATIO IN INTERNAL COMBUSTION ENGINES

BACKGROUND OF THE INVENTION

The invention is related to an apparatus for controlling the air-fuel quantity ratio in internal combustion engines. In a known apparatus of this kind, the diaphragm of the differential-pressure valve controls an outlet opening to a relief line in which there is a throttle at which a control pressure builds up for the actuation of a servo motor. As a result, the ratio of exhaust gas to fresh air is variable and the position of the fuel metering throttle device and of the fuel metering cross section is variable in accordance with the thus-varied fresh-air component. A preliminary supply pump is also provided for the fuel supply of the fuel injection pump. The supply pressure of this preliminary pump is held constant because this pressure serves at the same time to generate the constant restoring force which is exerted on the air flow rate meter.

It is a precondition for the desired mode of operation of this known apparatus that the entire fuel quantity traversing the metering cross section is carried via the fuel supply line to the injection pump and from there is also delivered to the combustion chambers of the internal combustion engine, so that the controlled air-fuel ratio can be maintained. The fuel injection pump can, accordingly, not be flushed or cooled with fuel which is flowing back to the fuel supply container, which is otherwise conventional. A means of cooling is possible, as also provided in the known apparatus, only by means of a supplementary cooler, by which fuel is diverted out of the injection pump chamber housing the pump piston drive means (which in many cases also serves as the intake and fuel supply chamber for supplying and relieving the pump working chambers) to the intake side of a supply pump additionally provided in the injection pump. This supply pump, in the known constructions of injection pumps, acts to generate a supply pressure in the injection pump chamber which varies in accordance with the engine speed.

OBJECTS AND SUMMARY OF THE INVENTION

The apparatus in accordance with the invention has the advantage over the prior art in that only a single supply pump is required, which also generates an rpm-dependent supply pressure for adjusting the device used for adjustment of the onset of injection. The invention also has the advantage in that the chamber which encloses the drive means for the pump piston is cooled by the flow of a quantity of fuel through it which is intended for flushing and which is then returned to the fuel supply container. In the fuel supply container, the heated fuel is recooled in an advantageous manner and then again delivered to the same chamber by the single supply pump.

The use of an injection pump constructed in accordance with the invention is particularly advantageous.

The invention will be better understood as well as further objects and advantages thereof become more apparent from the ensuing detailed description of the preferred embodiments taken in conjunction with the drawings.

DESCRIPTION OF THE PREFERRED EMBODIMENTS

Figure 1:
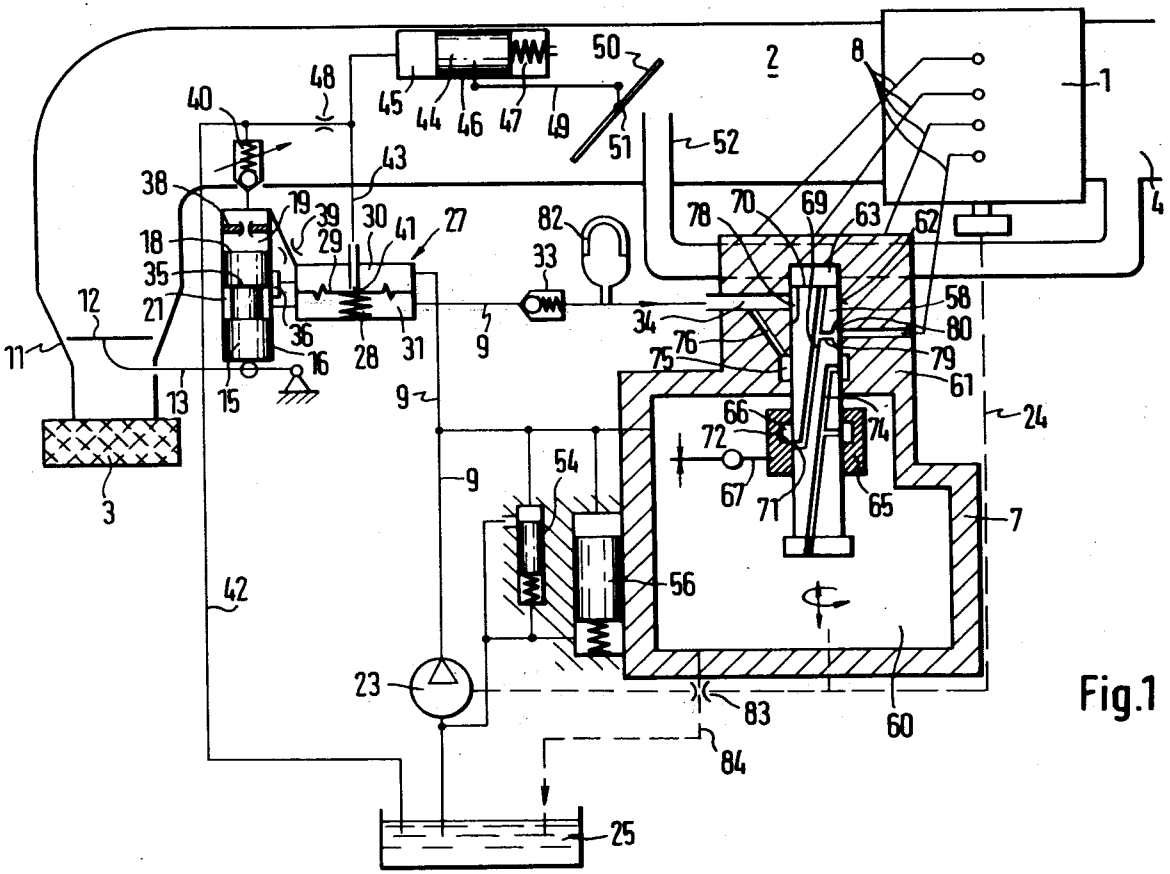
FIG. 1 shows a first embodiment with a distributor injection pump constructed in accordance with the invention.

Turning now to the drawings, in the embodiment of FIG. 1, an internal combustion engine 1 is shown in simplified form, with an intake manifold 2 having an induced air filter 3 at its inlet and having an exhaust manifold 4. The various combustion chambers of the internal combustion engine are supplied with fuel by an injection pump 7. The fuel injection pump 7 has feed lines 8 for this purpose and is supplied with fuel via a fuel supply line 9.

Adjacent to the induced air filter 3, the intake manifold has an air funnel 11 which enlarges in the direction of the flow toward the internal combustion engine 1. A baffle plate 12 can be pivoted against a substantially constant force in this air funnel 11, thus acting as an air flow rate meter. The baffle plate 12 is seated on a pivot arm 13, which is pivotable about a fixed point outside the intake manifold 2. A spool valve 15 embodied as a fuel throttling device engages the pivot arm 13 and is itself displaceable within a cylinder bore 16 closed on one end. The end face 18 of the spool valve 15 which is remote from the pivot arm 13 defines a working chamber 19 in the cylinder bore 16 which is filled with fuel under pressure. The spool valve 15 has an annular groove 21 which forms a closed annular chamber in the cylinder bore 16.

The injection pump 7 is supplied with fuel by means of a supply pump 23, which is driven by the internal combustion engine 1, as the broken line 24 in the drawing indicates. The supply pump 23 aspirates fuel from a fuel supply container 25 and delivers it via the fuel supply line 9 to a differential pressure valve 27. This valve 27 has a diaphragm 29 stressed by a spring 28 which separates a first pressure chamber 30 from a second pressure chamber 31 of the differential pressure valve 27.

The first pressure chamber 30 communicates with the fuel supply line 9 and is located upstream of the entry of the fuel supply line 9 into the cylinder bore 16 in the vicinity of the annular groove 21. The second pressure chamber 31 also communicates with the fuel supply line 9 at a point downstream of the subsequent exit of the fuel supply line 9 from the bore 16. The fuel supply line 9 thereafter leads via a check valve 33 to the intake bore 34 of the fuel injection pump 7.

At the entrance of the fuel supply line 9 into the cylinder bore 16, there is, in the illustrated example, a slot-like axial cross section which, with one limitation edge 35 of the annular groove 21, forms the metering cross section 36 of the fuel metering throttle device. Depending upon the degree of deflection of the baffle plate 12, there is established at this point a larger or smaller metering cross section, which varies in a preferably linear manner. While the metering cross section 36 can be closed completely, the exit of the fuel supply line 9 back out of the annular groove 21 can be blocked; that is, it is in continuous communication with the annular groove 21.

The working chamber 19 in the cylinder bore 16 is equipped with a throttle aperture 38 for the purpose of damping the motion of the spool valve 15 and communicates via a throttle 39 with the fuel supply line 9 upstream of the metering cross section 36 which, in the illustrated embodiment, is at the first pressure chamber 30 connected directly with the fuel supply line 9. Naturally, the metering cross section may instead be provided at the exit of the fuel supply line 9 out of the cylinder bore 16. In this case, the orientation of the control edge and the direction of motion of the spool valve 15 must be altered accordingly.

The working chamber 19 can be connected via a pressure maintenance valve 40 with a relief line 42, which leads back to the fuel supply container 25. A constant pressure, serving to reset the baffle plate 12, can be maintained with the pressure maintenance valve 40.

The end of an outlet line 43 protrudes into the first pressure chamber 30 of the differential pressure valve 27 and its opening in the first pressure chamber 30 is controlled by the position of the diaphragm 29. The outlet line 43 leads via an outlet throttle 48 to the relief line 42 and communicates upstream of the outlet throttle 48 with a working chamber 45, which is formed within a cylinder by a servo piston 44 of a servo motor 46. The servo piston 44 is displaceable against a restoring spring 47. Depending upon the deflection of the diaphragm 29, the quantity of fuel flowing through the outlet line 43 varies. This builds up a correspondingly variable control pressure at the outlet throttle 48 which becomes effective in the working chamber 45. A diaphragm servo element may also be used instead of the servo piston element 44.

The servo piston 44 is connected via a linkage 49 with a throttle valve 50 disposed downstream of the baffle plate 12 in the intake manifold 2. Downstream of the throttle valve shaft 51 is the discharge point of an exhaust feedback line 52 leading from the exhaust manifold 4. The discharge point is oriented toward the half of the throttle valve 50 located downstream of the throttle valve shaft 51 in such a manner that when the throttle valve 50 is fully opened, this half of the throttle valve closes the discharge point of the exhaust feedback line 52.

Instead of the illustrated embodiment, a separate closing device may naturally also be coupled with the throttle valve 50 which closes the discharge point of the exhaust feedback line 52 located downstream of the throttle valve 50. With the aid of the servo motor 46, the fresh-air component or the component of fed-back exhaust gas in the operational mixture supplied to the engine can thus be varied.

The portion of the embodiment of FIG. 1 which has been described so far operates as follows:

Depending on the position of the throttle valve 50 and the engine speed, a certain quantity of fresh air is delivered to the engine. This fresh air flows via the filter 3 into the funnel 11 of the intake manifold 2 and then flows through the gap defined between the baffle plate 12 and the air funnel 11. Because the baffle plate 12 is subjected to a restoring force, there is a pressure drop at the baffle plate 12 which tends to deflect the baffle plate 12 in the direction of the flow. If the restoring force is held constant, the deflection of the baffle plate 12 corresponds to the quantity of fresh air aspirated by the engine. The constant restoring force is generated in the working chamber 19 of the spool valve 15 in which a constant pressure is maintained separately by means of the throttle 39 with the aid of the pressure maintenance valve 40. This pressure is exerted on the spool valve 15 and presses it against the pivot arm 13. Although the supply pump 23, whose pressure side communicates with a pressure control valve 54, generates a supply pressure which can thereby be set in accordance with rpm, the desired constant pressure can still be maintained in the working chamber 19 with the aid of the throttle 39 and the pressure maintenance valve 40.

If the quantity of fresh air aspirated now increases because of an increase in engine speed, then the baffle plate 12, which at the outset is balanced, is deflected to such an extent that the same differential pressure is reestablished at the baffle plate 12 as before. This occurs because of the enlargement of the annular gap between the baffle plate 12 and the air funnel 11 which then takes place. The spool valve 15 is displaced accordingly as well, so that the limitation edge 35 enlarges the slot-like metering cross section 36 in such a manner that, at the pressure drop now provided by the differential pressure valve 27, more fuel can flow through this metering cross section 36, the annular groove 21, the second pressure chamber 31 and the check valve 33 to the fuel supply line 9 and thus to the injection pump 7. Thus, more fuel can be injected in accordance with the increased air quantity, because the fuel quantity carried through the fuel supply line 9 to the injection pump 7 does, in fact, reach the point of injection undiminished.

However, if the injection pump 7 does not accept the entire metered fuel quantity, then there is a pressure increased in the second pressure chamber 31 of the differential pressure valve 27. In that event, however, the diaphragm 29 is deflected in the direction in which the compression spring 28 exerts its force and reduces the cross section of the outlet opening 41, so that less fuel can flow out toward the outlet throttle 48.

The control pressure being established in the working chamber 45 of the servo motor 46 becomes correspondingly less, so that the servo piston 44 is displaced under the influence of the compression spring 47 in such a manner that the throttle valve 50 is again partially closed and the aspirated fresh-air quantity is somewhat reduced. The baffle plate 12 of the air flow rate meter is also displaced accordingly and thus reduces the metering cross section 36. Thus, the quantity of fuel flowing in at the metering cross section 36 is equal to the quantity accepted by the fuel injection pump 7, and the diaphragm 29 again assumes the balanced position in the differential pressure valve 27.

In this manner, it is possible to maintain a desirable relationship of air quantity to fuel quantity over the entire operational range, with fed-back exhaust gas taking over the task of remnant filling of the engine's combustion chambers. By the appropriate special configuration of the air funnel 11, a desirable relationship of fuel to air can be set, given a metering cross section 36 which varies in a linear fashion, at various operational states and at various air throughput quantities.

By appropriate special configuration of the air funnel 11, it is possible to assure that the baffle plate 12, depending on its initial position, will perform a greater or lesser pivoting movement in order to obtain the same change in cross section at the annular gap. The apparatus also functions in accordance with the invention whenever a pressure is generated by the supply pump 23, as already noted which is dependent on operational parameters of the engine, such as its rpm.

In the known apparatuses of this kind, it was disadvantageous in that the fuel injection pump 7 would receive only that quantity of fuel which was also delivered through the feed lines 8 of the engine. That meant that the fuel injection pump 7 could not be flushed, or that it could be flushed only with the aid of a supplementary cooler from which the fuel was carried back again to the injection pump. These injection pumps are provided with a separate supply pump which further serves to generate an rpm-dependent pressure which can actuate a device for adjusting the onset of injection.

Such a device is provided in the embodiment according to the invention as well, the final control element 56 of which is shown in FIG. 1. This element 56 is a piston which is displaced by the pump supply pressure against a restoring force and which can be used to vary the initiation of the stroke of a pump piston 58 of the injection pump 7. It is also possible to flush the injection pump 7 according to the invention with fuel without any adverse effect on the precision of the fuel metering.

The injection pump 7 according to the invention is formed as a distributor injection pump. It is shown in simplified form in FIG. 1, with known elements omitted and only the embodiment in accordance with the invention being shown. The pump 7 has a chamber 60 in which the known drive elements of a distributor pump are housed, such as the cam plate and the controller of the pump. The pump has a single pump piston 58 which is driven by the cam plate to reciprocate and at the same time to rotate as indicated by the arrows. This piston 58 is guided tightly within a cylinder bore 62, closed at one end, and within this bore it encloses a pump working chamber 63. An annular control slide 65 is displaceably disposed on the portion of the pump piston 58 which protrudes into the chamber 60. The control slide 65 has an internal annular groove 66 and is displaceable axially on the pump piston 58 by a control lever device 67 which is shown in simplified form.

The control lever device 67 is part of a controller, not further illustrated, of the fuel injection pump 7 and also serves the purpose of arbitrary adjustment of the fuel injection quantity. To this end, the pump piston 58 has a relief channel 69 which, beginning at the end face 70 of the pump piston 58 facing toward the pump working chamber 63, extends longitudinally through the pump piston 58 and exits laterally from the pump piston 58 in the vicinity of the control slide 65.

The exit opening 71 of the relief channel 69 is oriented toward the control slide 65 in such a manner that this opening 71 is closed in the lowermost, initial position of the pump 58, at the onset of the supply stroke. In the course of the supply stroke of the pump piston 58, this opening 71 sooner or later, depending on the position of the control slide 65, passes the limitation edge 72 of the internal annular groove 66 which acts as a control edge and thus the opening 71 opens into the annular chamber formed by the internal annular groove 66. This annular chamber, in turn, is constantly in communication with a connecting bore 74 extending in the pump piston 58; that is, this communication is independent of any possible position of the control slide 65. The connecting bore 74 in turn discharges into an annular groove 75, which surrounds the pump piston 58 in the housing 61 and communicates via a second portion 76 of the connecting line with the intake bore 34 of the injection pump 7.

The fuel quantity conveyed through the fuel supply line 9 is introduced during the intake stroke of the pump piston 58 into the pump working chamber 63 via the intake bore 34. To this end, the pump piston 58 has longitudinal grooves 78 uniformly distributed on the circumference of its jacket surface at its upper end, which correspond in number to the number of cylinders in the engine to be supplied, or to the number of the supply and intake strokes of the pump piston 58 per revolution. These longitudinal grooves 78 thus communicate with the intake bore 34 during the intake stroke of the pump piston 58.

At the onset of the supply stroke, the intake bore 34 is closed by the intervening rotation of the pump piston and the fuel located in the pump working chamber 63 is carried via the relief channel 69 and a radial bore 79 branching off from channel 69 to a longitudinal distributor groove 80 in the jacket surface of the pump piston 58. During the supply stroke, the longitudinal distributor groove 80 at any given time overlaps one of the feed channels 8 leading from the cylinder bore 62, which channels 8 are also distributed uniformly on the circumference.

In order to change the effective supply stroke, as already noted, the control slide 65 is provided, which with its control edge 72 and depending on its setting sooner or later opens the exit opening 71 of the relief channel 69 during the supply stroke of the pump piston 58. The remaining fuel supplied by the pump piston 58 no longer flows via the feed lines 8, but rather via the internal annular groove 66, the connecting bore 74, the annular groove 75 and the second portion 76 of the connecting bore and back to the intake bore 34.

A storage chamber 82 is provided for the storage of the fuel which is returned. This storage chamber 82 is particularly necessary because of the check valve 33. In this manner, the quantity of diverted fuel remains the same, so that only that quantity of fuel is in fact delivered via the fuel supply line 9 to the fuel injection pump 7 which then also proceeds via the feed lines 8 into the engine.

In contrast, the chamber 60 can now be flushed without adverse consequences. To this end, a flushing throttle 83 is provided which is seated in a flushing line 84 which branches off from the chamber 60. The flushing throttle 83 determines the flushing quantity which flows through the chamber 60 and back to the fuel supply container 25. The fuel supply container 25 thus serves advantageously as a re-cooler. Thus, the heat arising in the pump, particularly in the chamber 60 which includes the drive means of the pump piston 58, and any gas bubbles which may arise, can be carried off.

Figure 2:
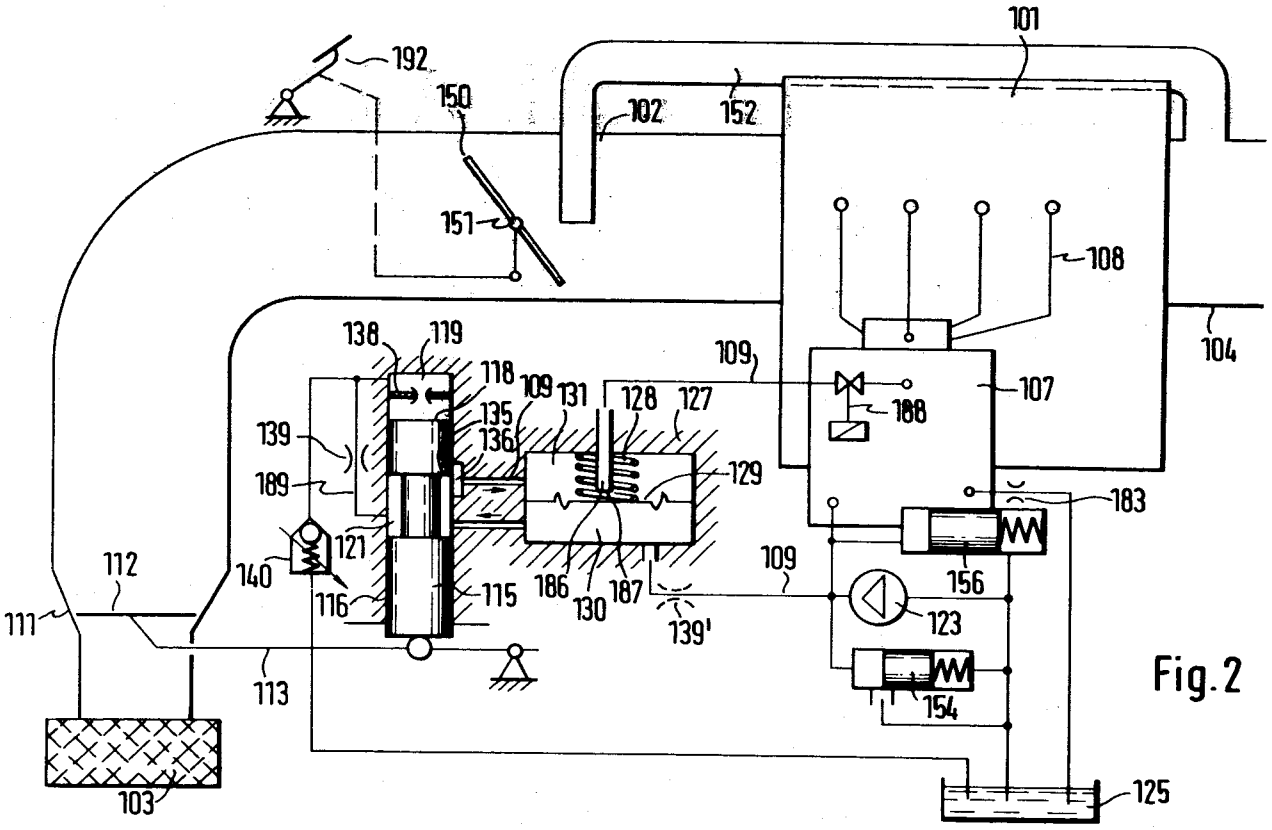
FIG. 2 shows a second embodiment of the invention with an injection pump formed as a radial piston pump.

FIG. 2 shows a second possible application of the embodiment in accordance with the invention. As in FIG. 1, an internal combustion engine 101 is shown in simplified form. The engine 101 is supplied with fuel by a fuel injection pump 107 via feed lines 108. The intake manifold 102 of the engine again has an induced air filter 103 at its inlet, downstream of which the intake manifold enlarges in the form of an air funnel 111. The air funnel 111, as in the embodiment of FIG. 1, is part of an air metering apparatus which comprises a baffle plate 112 which is displaceable in the vicinity of the air funnel 111 and is subjected to a constant restoring force by way of a pivot arm 113 to which it is secured. To this end, as in the embodiment of FIG. 1, there is a spool valve 115 which engages the pivot arm 113. The other end face 118 of spool valve 115 encloses a working chamber 119, which is under constant pressure within the cylinder bore 116 in which the spool valve 115 is tightly displaceable.

The spool valve 115 has an annular groove 121, one limitation edge 135 of which determines the metering cross section 136 at a slot-like exit opening of a fuel supply line 109 leading to the injection pump 107. As in the embodiment of FIG. 1, a fuel supply container 125 is arranged to contain the fuel supply. A supply pump 123 aspirates fuel from the fuel supply container 125. The supply pressure of the supply pump 123 is determined by a pressure control valve 154, by means of which an rpm-dependent supply pressure can be generated. This rpm-dependent pressure is also delivered to the chamber, not further illustrated here, which includes the drive means of the fuel injection pump 107.

A final control element 156 of an adjusting means for the onset of injection is also subjected to this supply pressure. As in the embodiment of FIG. 1, a certain quantity of fuel is withdrawn via a flushing throttle 183 from the chamber of the fuel injection pump 107 which includes the drive means of the injection pump and then is delivered back to the fuel supply container 125. The supply pump 123 and the injection pump 7 are driven in common by the internal combustion engine 101 and are shown separately in FIG. 2 only for reasons of clarity.

The fuel supply line 109 leading off from the supply pump 123 in the embodiment of FIG. 2 enters the chamber formed by the annular groove 121 and cannot be closed. Upstream of this entrance, the annular groove 121 communicates with a first pressure chamber 130 of a differential pressure valve 127. This pressure chamber 130 may, as shown, also be located in the line itself. The first pressure chamber 130 is separated by a diaphragm 129 from a second pressure chamber 131 in which a compression spring 128, acting upon the diaphragm 129, is disposed. The fuel supply line 109 leading from the metering cross section 136 discharges into the second pressure chamber 131. A short tube element 186, protruding into the second pressure chamber 131 perpendicular to the diaphragm 129, provides the exit opening for this supply line 109. Its opening 187 is controlled by the position of the diaphragm 129. From the tube 186, the fuel supply line 109 leads further to the fuel injection pump 107. A magnetic valve 188 can also be interposed between the tube 186 and the injection pump 107.

The working chamber 119 communicates through a branch line 189 with the chamber formed by the annular groove 121 and thus also with the pump supply pressure of the supply pump 123 which prevails upstream of the metering cross section 136. A throttle 139 is disposed in the branch line 189 which uncouples the working chamber 119. A pressure maintenance valve 140 is also provided, as in the embodiment of FIG. 1, by means of which the working chamber 119 can be relieved toward the fuel supply container 125, as soon as the intended pressure level has been exceeded. In order to damp the motion of the spool valve 115, a throttle aperture 138 is disposed in the working chamber 119 between the entrance of the branch line 189 and the end face 118.

In order to vary the fresh-air quantity delivered to the internal combustion engine, there is also a throttle valve 150 provided downstream of the baffle plate 112 in the intake manifold 102. This throttle valve 150 may be actuated, for example, by a gas pedal 192. Downstream of the throttle valve shaft 151, an exhaust feedback line 152 communicating with the exhaust manifold 104 discharges into the intake manifold 102 in such a manner that when the throttle valve 150 is fully opened, the opening of the exhaust feedback line 152 is closed by the half of the throttle valve 150 located downstream of the throttle valve shaft 151.

The apparatus described above operates as follows:

If, given a balanced ratio of fuel to air at the outset, the quantity of fresh air aspirated by the engine varies, which may occur at a constant setting of the throttle valve 150 (for instance, by varying the rpm in the event of increasing or decreasing load), then the baffle plate 112 imitates this variation in that it is deflected in either a positive or a negative direction and thus changes the metering cross section 136. This change first effects a pressure change in the second pressure chamber 131 until, as a result of the corresponding deflection of the diaphragm 129, the metering cross section at the opening 187 is also changed accordingly and delivers a quantity of fuel, adapted to the changed circumstances, to the fuel injection pump 107. This fuel injection pump 107 is an intake throttle pump of the type which includes radial pumping pistons. Fundamentally, such pumps are supplied with only that fuel which is then forced by the pumping piston into the supply lines. The variable fill quantity during the intake stroke determines the working stroke of the pumping piston.

The magnetic valve 188 in the fuel supply line 109, described above, serves to block the fuel supply under marginal conditions or while turning off the engine. This magnetic valve 188 may be used, for example, to drive an excess-rpm safety means.

Instead of the throttle 139 provided in the branch line 189, similar throttle 139' shown in broken lines may also be disposed upstream of the connection between the first pressure chamber 130 and the fuel supply line 109. In this embodiment, a constant pressure is maintained downstream of this throttle 139' with the aid of the pressure maintenance valve 140, so that a pressure level is obtained for the fuel delivered to the injection pump 107 which is independent of the engine speed.

In this embodiment as well, an exact setting for the fuel-air ratio to predetermined values can be obtained over the entire operational range of the internal combustion engine, while requiring only one fuel supply pump of the kind already provided in known fuel injection pumps. In addition, it is possible to direct a quantity of fuel through the fuel injection pump to flush and cool it and it is also possible to perform an adjustment of the onset of injection with the supply pressure which changes in accordance with the engine speed.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. An apparatus for controlling the fuel-air quantity ratio of the operational mixture to be introduced into the combustion chambers of an internal combustion engine including an air flow rate meter disposed in the intake manifold of the engine, a servo device having a working chamber, said air flow rate meter being movable under differential pressure against a substantially constant hydraulic restoring force generated in said servo device working chamber, a fuel supply line, a fuel metering throttle device in said fuel supply line having a metering cross section, and a working chamber, a fuel supply pump for supplying fuel to said fuel supply line, the displacement of said air flow rate meter being arranged to actuate said fuel metering throttle device, a fuel injection pump having at least one pump piston and one pump working chamber connected to said fuel supply line, said fuel injection pump being provided with fuel feed channels leading to injection points in said engine, and including a differential pressure valve whose pressure chambers are subjected to the pressures present at said metering cross section of said fuel metering throttle device, the differential pressure valve maintaining a constant pressure drop at the metering cross section and wherein said working chamber in said fuel metering throttle device upstream of said metering cross section communicates with the fuel supply line, wherein said fuel supply pump is associated with said fuel injection pump, said fuel injection pump having a working chamber and a fuel-filled chamber including the drive means for the pump piston, a pressure control valve, means for communicating the supply side of said fuel supply pump with said pressure control valve for setting a variable supply pressure and with said fuel-filled chamber, means including a flushing throttle for conducting fuel out of said fuel-filled chamber in a pressure-relieved manner via said flushing throttle, a throttle for uncoupling the variable supply pressure of said fuel supply pump, a pressure maintenance valve for setting the pressure becoming effective at least in the working chamber of said fuel metering throttle device downstream of said throttle to a constant value, and means for communicating said injection pump working chamber with said fuel supply line excluding said feed channels.

2. An apparatus in accordance with claim 1 wherein said fuel injection pump comprises a distributor injection pump having a housing, a pump piston driven to reciprocate with a constant stroke and simultaneously to rotate, said pump having a working chamber and a cylinder having a bore in which said pump piston is disposed, said pump piston having an exit opening disposed laterally thereon and extending longitudinally therethrough and a relief channel connecting said pump working chamber with said relief channel exit opening, said pump including at least one intake bore discharging into said cylinder bore and a connecting bore leading to said intake bore, a longitudinally displaceable control slide associated with said pump piston for varying the effective supply stroke of said pump piston, said control slide having a control edge for controlling said relief channel exit opening, wherein the pump working chamber can be supplied with fuel during the intake stroke of said pump piston via said at least one intake bore, said control slide comprising an annular slide having an internal annular groove which, together with said pump piston, forms an annular chamber which communicates in each of the working positions provided for said annular slide with the exit opening of said connecting bore leading to said intake bore.

3. An apparatus in accordance with claim 2 including an annular chamber in said pump housing surrounding said pump piston and wherein said connecting bore has a portion extending within said pump piston which discharges into said annular chamber, said connecting bore having a second portion communicating with said annular chamber and which leads through the pump housing to said intake bore of said fuel pump.

4. An apparatus in accordance with claim 1 wherein said injection pump comprises an intake throttle injection pump.

5. An apparatus in accordance with claim 1 wherein said differential valve includes a pair of pressure chambers, one of said pressure chambers having an outlet opening, a spring-loaded control element in said differential pressure valve and for controlling said outlet opening.

6. An apparatus in accordance with claim 5 wherein said servo device comprises a servo motor and including a throttle and wherein said outlet opening is controlled by the non-spring-loaded side of the control element and wherein the fuel quantity through said outlet opening exiting upstream of said metering cross section of said fuel metering throttle device forms a control pressure at said throttle by means of which said servo motor affecting the fuel metering cross section can be actuated in order to maintain a constant differential pressure.

7. An apparatus in accordance with claim 5 wherein said outlet opening is controlled by the spring-loaded side of said control element and is part of said fuel supply line located downstream of said fuel metering cross section.

8. An apparatus in accordance with claim 7, including an arbitrarily actuatable throttle apparatus disposed in said intake manifold and wherein the guide value for the load to be set for the engine is the position of said arbitrarily actuatable throttle apparatus.

9. An apparatus in accordance with claim 8 including an exhaust gas feedback line discharging into said intake manifold and wherein said throttle apparatus comprises a throttle valve disposed downstream of said air flow rate meter in said intake manifold, the portion of the throttle valve located downstream of the throttle valve shaft serving as the closing element for said exhaust gas feedback line, said exhaust gas feedback line being closed when the throttle valve is opened.

10. An apparatus as claimed in claim 1, wherein: said pressure control valve is connected to its input side to said fuel throttling device and on its output side through a throttling valve to said working chamber of said servo device.

* * * * *